US010434674B2

(12) United States Patent
Bagley et al.

(10) Patent No.: US 10,434,674 B2
(45) Date of Patent: Oct. 8, 2019

(54) HAND HELD SPIRALIZER

(71) Applicant: Progressive International Corporation, Kent, WA (US)

(72) Inventors: Justin Bagley, Seattle, WA (US); Jacob Heiberg, Charlottenlund (DK)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 15/923,358

(22) Filed: Mar. 16, 2018

(65) Prior Publication Data

US 2018/0264671 A1 Sep. 20, 2018

(51) Int. Cl.

| | |
|---|---|
| ***B26D 3/11*** | (2006.01) |
| ***B26D 3/28*** | (2006.01) |
| ***B26D 7/06*** | (2006.01) |
| ***B26D 3/26*** | (2006.01) |

(52) U.S. Cl.

CPC ..... *B26D 3/11* (2013.01); *B26D 3/26* (2013.01); *B26D 3/283* (2013.01); *B26D 7/0666* (2013.01); *B26D 2003/288* (2013.01); *B26D 2210/02* (2013.01)

(58) Field of Classification Search

CPC .... B26D 3/11; B26D 3/283; B26D 2003/288; B26D 2210/02; B26D 7/0666; B26D 3/26; A47J 17/02

USPC ... 30/279.2, 325, 124, 123.5, 454, 457, 458, 30/459

See application file for complete search history.

(56) References Cited

U.S. PATENT DOCUMENTS

| | | | | | |
|---|---|---|---|---|---|
| 941,631 | A * | 11/1909 | George | | |
| 1,889,912 | A * | 12/1932 | Barcelo | A47G 19/28 | 30/124 |
| 3,999,293 | A * | 12/1976 | Zubrycki | B26B 27/00 | 30/124 |
| 4,704,959 | A * | 11/1987 | Scallen | B26D 3/22 | 83/356.3 |
| 5,363,745 | A * | 11/1994 | Lin | A47G 19/14 | 220/230 |
| 6,195,898 | B1 * | 3/2001 | Lemisch | B26B 1/04 | 30/153 |
| 9,333,659 | B2 * | 5/2016 | Schillheim | A47J 43/0705 | |
| 9,565,962 | B2 * | 2/2017 | Chang | A47J 17/02 | |
| 2016/0101534 | A1 * | 4/2016 | Schillheim | B26D 3/11 | 83/423 |
| 2017/0080588 | A1 * | 3/2017 | Bagley | B26D 3/26 | |
| 2018/0264671 | A1 * | 9/2018 | Bagley | B26D 3/11 | |

FOREIGN PATENT DOCUMENTS

| | | | |
|---|---|---|---|
| CA | 2 998 355 | A1 * | 9/2018 |
| DE | 10 2015 109 403 | A1 * | 12/2016 |

* cited by examiner

*Primary Examiner* — Hwei-Siu C Payer
(74) *Attorney, Agent, or Firm* — Lowe Graham Jones PLLC

(57) ABSTRACT

A hand held spiralizer includes two housing portions pivotally joined to one another to allow the housing to open and close. A pair of handle portions cooperate to form a unified handle in the closed position. A main slicing blade extends along an interior sidewall for spiral cutting, while a set of julienne blades is mounted for selective pivotal movement for optional use.

13 Claims, 5 Drawing Sheets

HAND HELD SPIRALIZER

PRIORITY CLAIM

This application claims the benefit of U.S. provisional application No. 62/472,429, filed Mar. 16, 2017, the contents of which are incorporated by reference.

FIELD OF THE INVENTION

This application relates to devices for cutting vegetables in a spiral shape.

BACKGROUND OF THE INVENTION

A cone-type spiral slicer can include a blade along the sidewall for cutting a vegetable into thin strips. One of the defects of such devices is that they do not include the ability to selectively allow either wide strips or thin julienne strips to be cut in the same device and using the same blade, and they can be difficult to hold while simultaneously rotating the food item into the slicer.

SUMMARY OF THE INVENTION

A hand-held spiralizer, in one version, includes a first housing portion pivotally connected to a second housing portion for movement between an open position in which the first housing portion is pivoted away from the second housing portion and a closed position in which the first housing portion is pivoted toward the second housing portion, the first and second housing portions cooperating to form a cone having an interior space defined by an interior sidewall in the closed position, each of the first and second housing portions having a base end and a vertex end, the base end forming an open upper rim of the housing and the vertex end forming a lower opening in the housing.

A first handle portion is attached to and extends laterally away from the vertex end of the first housing portion, and a second handle portion is attached to and extends laterally away from the vertex end of the second housing portion. Preferably, the first handle portion and the second handle portion are positioned close one another to one another to form a handle when the first housing portion and the second housing portion are in the closed position.

A blade is attached to the interior sidewall of the first housing portion and having a sharp edge extending in a direction from the base end to the vertex end.

In one version, a plurality of julienne blades is mounted on a julienne blade post, the julienne blade post being pivotally attached to the housing for pivotal movement between an extended position in which the julienne blades extend into the interior space, and a retracted position in which the julienne blades are rotated away from the interior space.

The julienne blade post is may be attached to the first housing portion.

In one version, the julienne blade post is mounted to the first housing portion at the vertex and at the base end for pivotal movement along the sidewall.

In a preferred example, the first housing portion includes a first edge and the second housing portion includes a second edge, the first edge being adjacent the second edge when the first and second housing portions are in the closed position, the first edge further having a cutout configured to support the julienne blade post for pivotal movement.

In one example, the second edge of the second housing portion includes a second cutout, the second cutout being configured to allow the plurality of julienne blades to extend into the cutout when the julienne blades are rotated to the retracted position.

Preferably, the julienne blade post further comprises a flange extending laterally away from the julienne blade post in a direction transverse to the direction in which the julienne blades extend from the julienne blade post.

The julienne blade post preferably rotates 90 degrees between the extended position and the retracted position.

A fastener may be positioned on at least one of the first handle portion or the second handle portion for retaining the first handle portion against the second handle portion. In one version, the fastener comprises at least one magnet.

The hand-held spiralizer may include a gripper having a handle and a plurality of spikes, the gripper being sized to fit within the upper rim of the housing.

An upper end of the housing includes a rib formed on the upper rim of the sidewall of the housing, the rib being positioned to limit travel of the gripper into the housing.

The first housing portion and the second housing portion preferably divide the housing into equal halves.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
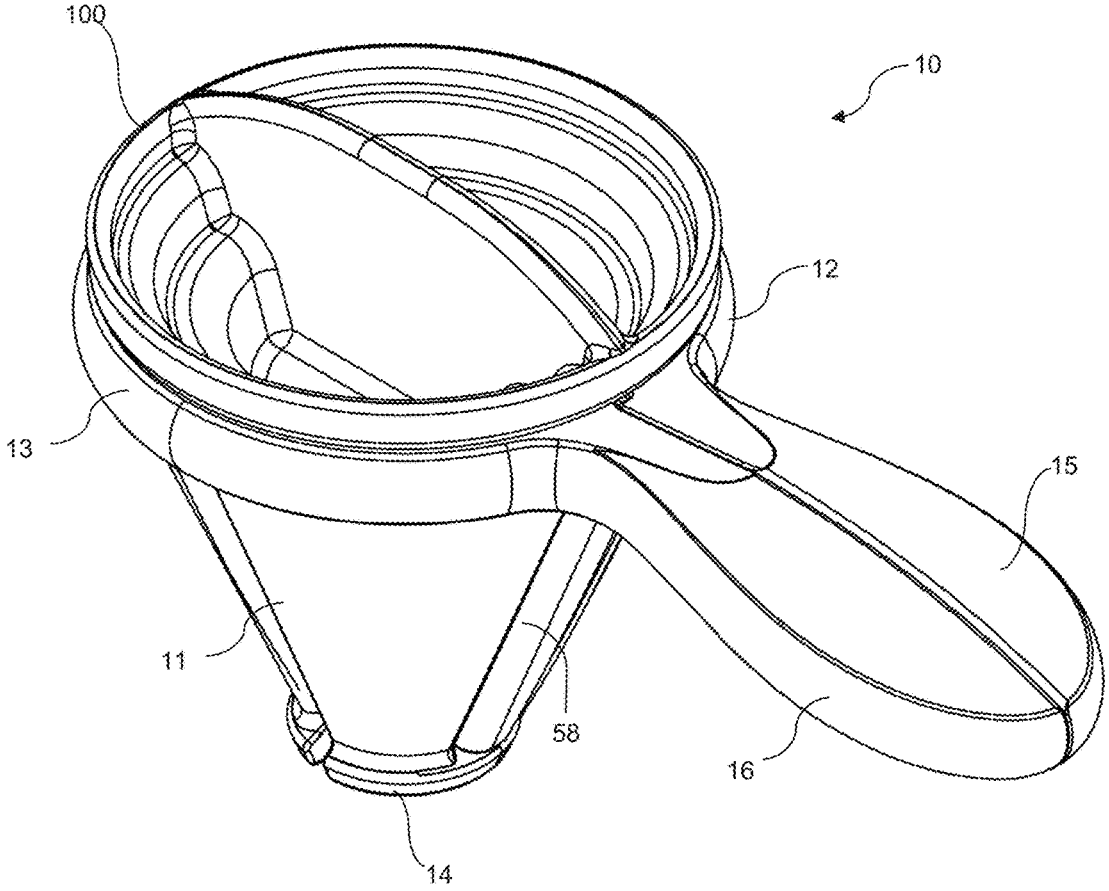
FIG. 1 is a top perspective view of a preferred spiralizer, shown with a gripper in position atop the spiralizer.
Figure 2:
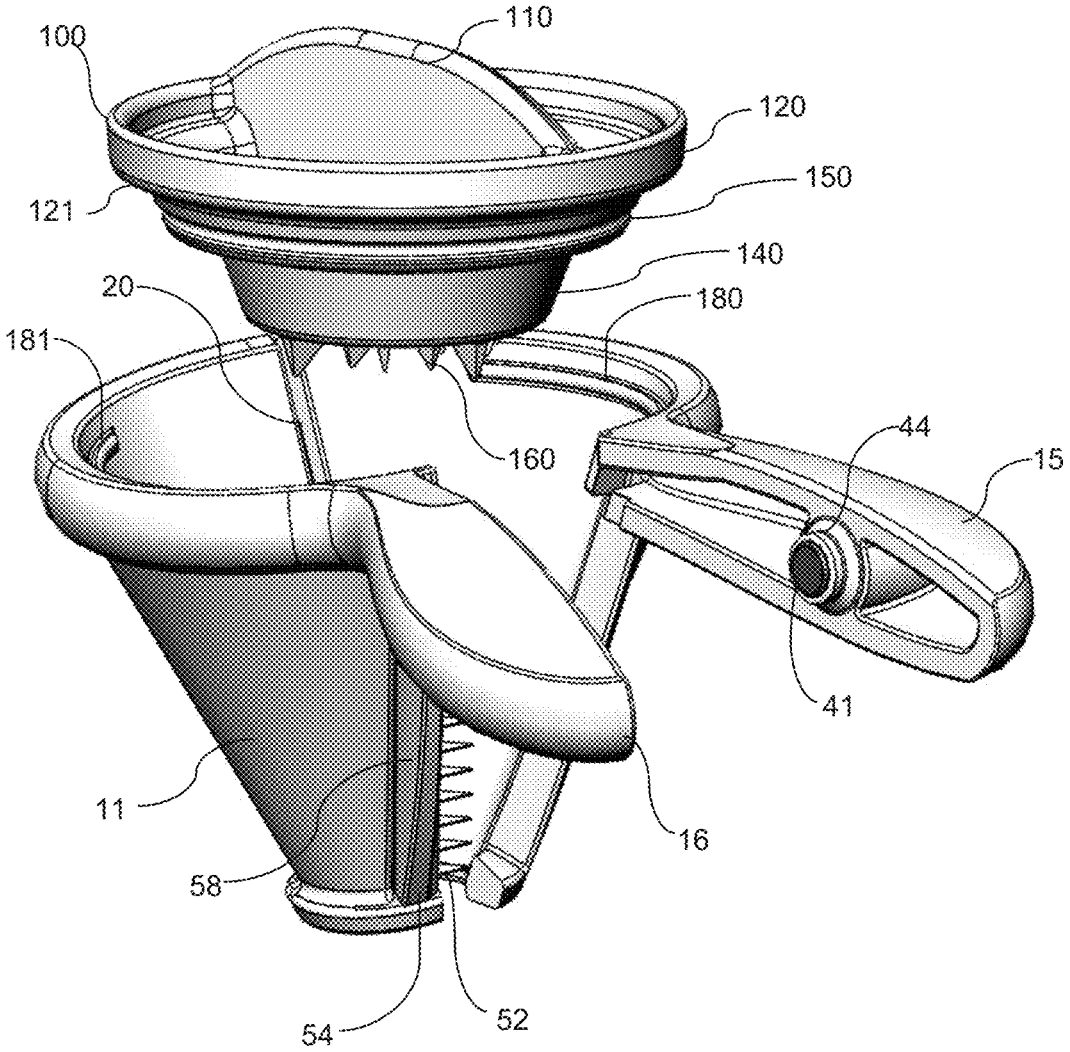
FIG. 2 is a front partially exploded view of the preferred spiralizer, shown with the spiralizer in a partially open position.
Figure 3:
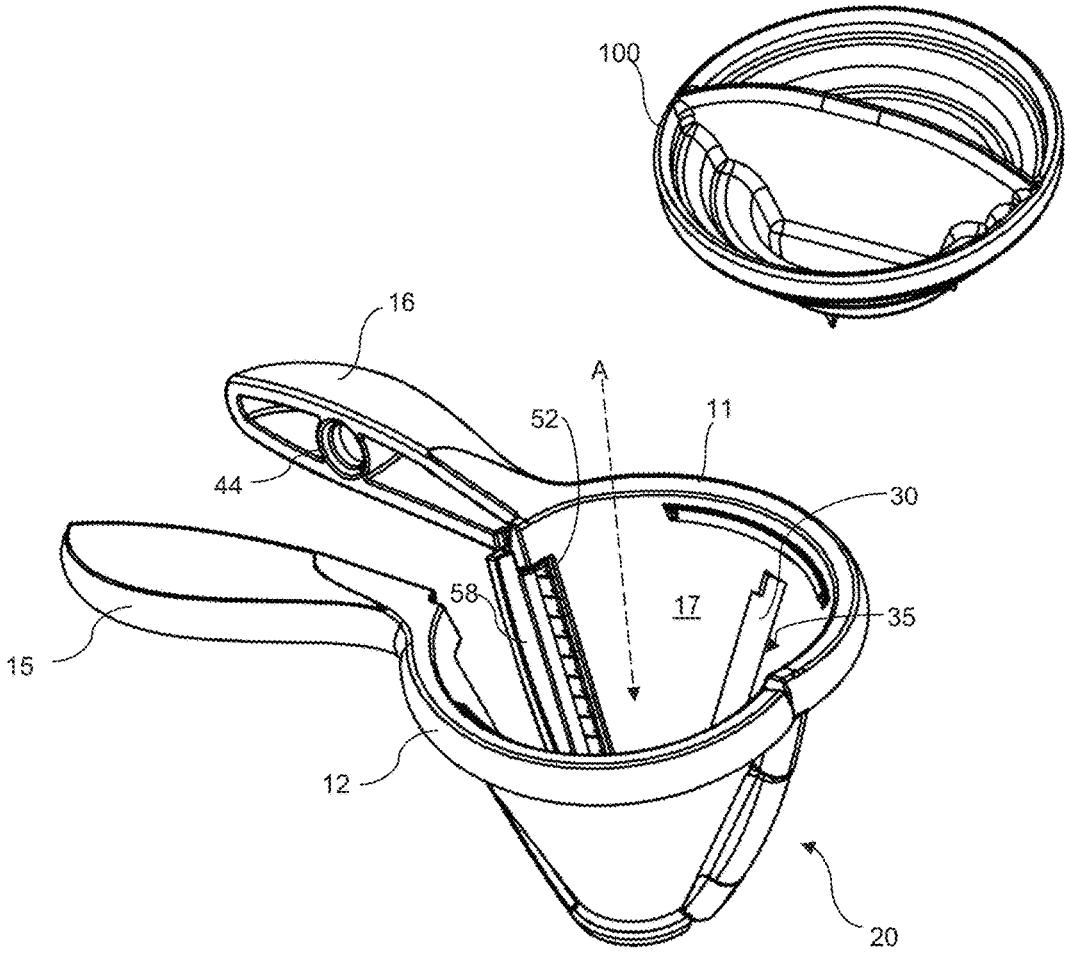
FIG. 3 is a rear partially exploded view of the preferred spiralizer.
Figure 4:
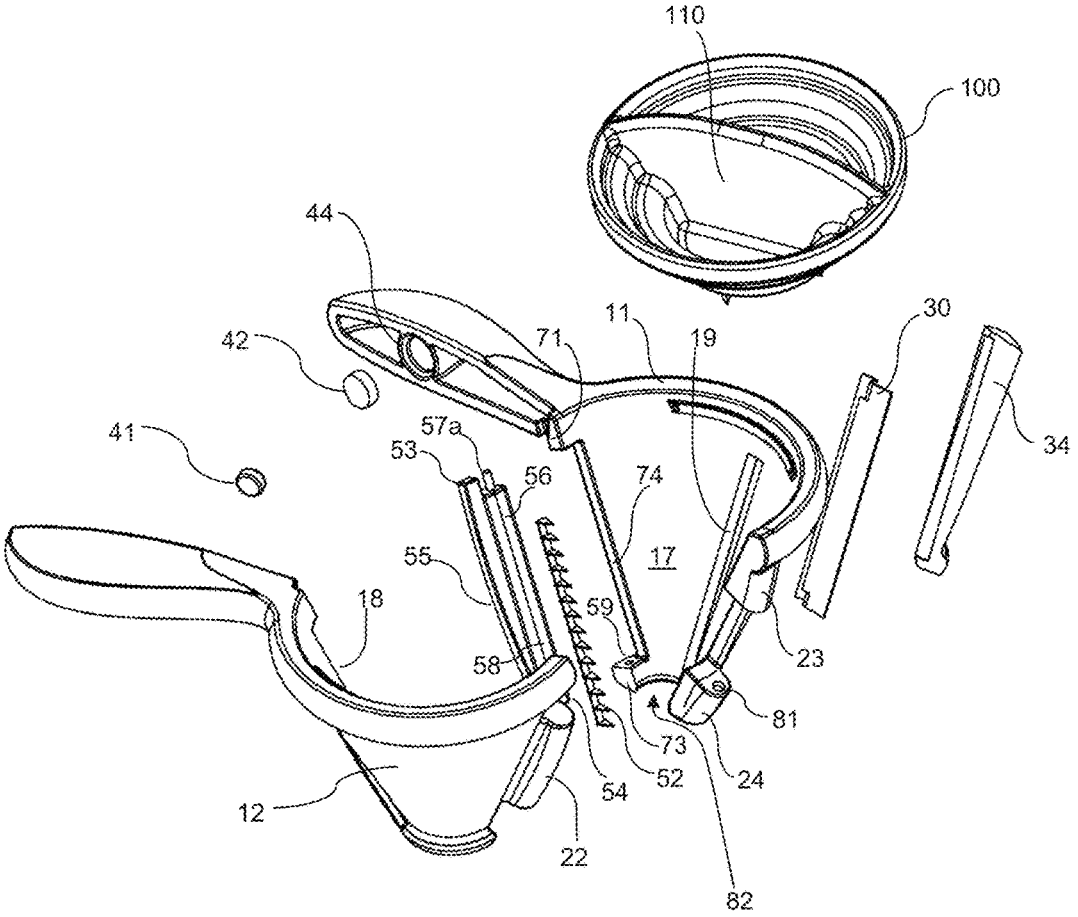
FIG. 4 is a rear perspective exploded view of the preferred spiralizer.
Figure 5:
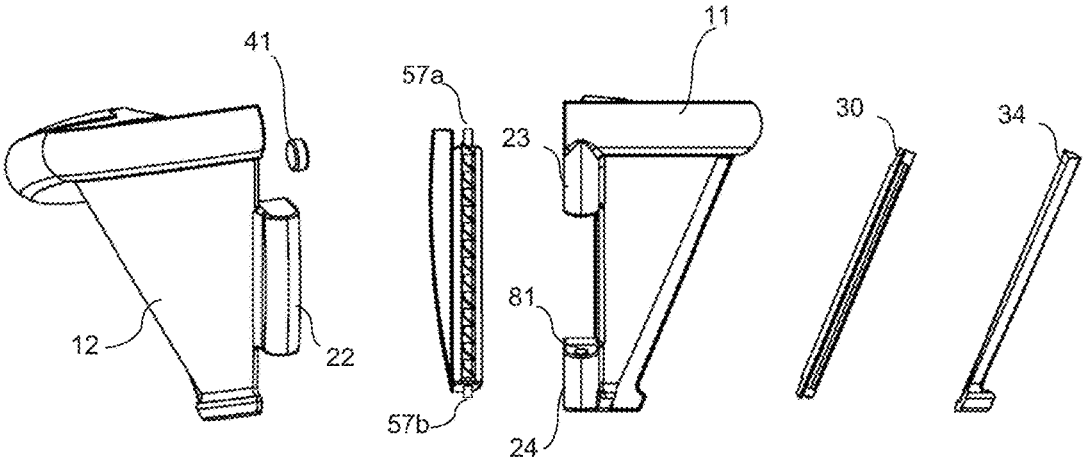
FIG. 5 is a side elevational exploded view of the preferred spiralizer.

A preferred spiral slicer 10 as illustrated in FIG. 1 includes a housing formed in a conical shape having a base 13 and a vertex 14. In the illustrated example the cone is shown as essentially inverted, with the vertex at the bottom and the base at the top. As a device intended to be hand-held, the orientation may vary according to the manner a user prefers to hold the device when in use. The base and vertex preferably are each open, and in the illustrated example the base is formed as a large open rim of the spiral slicer (as best seen in FIGS. 2 and 3), allowing it to receive relatively large vegetables or other items for slicing. The vertex, by contrast is relatively narrow and terminates in a small opening 82 in the illustrated version, as best seen in FIG. 4.

In the illustrated example, the slicer housing is formed in two portions or halves 11, 12 (though the portions need not be evenly sized) that are pivotally connected along a pivot location 20 which bifurcates the housing into substantially equal portions. The pivot location or hinge extends along a portion of the inclined sidewall of the cone. Each of the two portions includes an end which will be referred to as a vertex end (although, with the small opening it is not quite a true vertex though referred to as a vertex end in order to provide a point of reference) and a base end, so that each portion mates with the other portion along interfaces extending from the base to the vertex. Accordingly, and as discussed further below, the cone can pivot between an open and a closed position, primarily to facilitate cleaning of the slicer and to allow rotation of the julienne blades. The first and second portions pivot along the hinge, and have opposite sides that mate along an interface between the vertex end and the base end.

Each of the halves of the housing includes a handle portion 15, 16, which preferably extends radially away from the upper rim at the base end of the housing. The handle portions join together when the housing is in the closed position, so that a user can grasp both handle portions in one hand at the same time, which together form a handle for the housing. Thus, as seen in FIG. 1, the first and second handle portions 15, 16 are positioned against one another to form a handle.

In the illustrated example, the handle portions each include a magnet 41, 42 embedded within a seat, e.g. 44, formed in each of the handle portions. The magnets are arranged to attract one another when the housing is in the closed position, so that the magnets urge the handles toward one another, and therefore hold the housing in the closed position. In other versions, a different releasable fastener may be used with the handle portions, such as interlocking clips or other cooperating surfaces in place of the magnets.

In general, the slicer is operable by a user to slice a food item (such as a carrot, for example) by inserting the food item into the cone in the direction of the arrow indicated by axis A in FIG. 3, which extends through the center of the cone forming the slicer 10. As the food item is axially inserted, it is also rotated about the central axis A in a direction so that the food item first encounters the julienne blades and then the main slicing blade. This axial insertion and combined rotation will cause the food item to encounter the blade 30, slicing the food item in a circular fashion as it is inserted and rotated. As shown, the blade 30 is positioned at a location along the interior sidewall 17 of the cone, and in this case mounted on the first cone half 11.

The halves 11, 12 of the cone are hingedly attached along a hinge barrel extending outward from the cone at a hinge location 20. The barrel is formed by an upper knuckle 23 and lower knuckle 24 positioned on the first cone half 11, and a central knuckle 22 positioned on the second cone half 12. The knuckles may be joined together by a separate pin extending through the knuckles, or by one or more integrally formed pins mating with complementary recesses, e.g. 81, formed in adjacent knuckles. It should further be appreciated that the cone halves 11, 12 need not be formed as evenly divided halves, but rather one section or the other of the cone portions 11, 12 may be larger than the other.

The seam of the cone housing opposite the hinge is defined by the mating open edges of the cone halves, and is configured to open and close, using the handle portions to open and close the cone as desired.

A plurality of julienne blades 52 are seated within one of the cone halves 11, and are moveable between an extended and a retracted position, mounted within a housing along the seam dividing the halves of the housing. In the extended position, the julienne blades 52 are directed inward, toward the middle of the cone, such as in the position shown in FIG. 3. In the retracted position, the julienne blades are rotated 90 degrees so that they are retracted within the sidewall forming the cone housing, such as in the position shown in FIG. 2.

The julienne blades are mounted to a blade post 58 formed with an upper section 53 and a lower section 54. The blade post preferably includes a generally flat edge 56 which is configured to provide a surface for mounting the set of julienne blades 52. Thus, the julienne blades are most preferably formed in a triangular shape, in which a base of each blade is attached to the blade post along the flat edge 56 of the blade post, and the sharpened blade surface extends outward from the post.

The blade post includes a lateral flange 55, preferably extending substantially along the length of the vertical blade post, and substantially perpendicular to the orientation of the julienne blades. A user may grasp the flange as a handle to rotate the blade post, and therefore the julienne blades, between the extended and retracted positions. Most preferably, the blade post is preferably pivotable through an angle of about 90 degrees within the housing.

The blade post includes pins 57*a*, 57*b* extending axially and positioned at the upper and lower ends of the blade post. The pins are received in mating recesses formed in the blade post and also in recesses, e.g. 59, formed on upper and lower supports 71, 73 formed on the first conical section 11. The first cone half defines a first cutout 74 between the upper and lower supports, with the cutout being sized to receive the blade post. This manner of attachment allows the blade post to rotate on the first conical section as described above.

When the blade post rotates to a deployed or extended position, the outer surface of the blade post will abut either the first housing portion, the second housing portion, or both, thereby preventing over-rotation of the set of blades.

One of the cone sections 12 (that is, the half that is not mounted to the julienne blade mount) is preferably formed with an open edge that is recessed along a central portion, forming a second cutout region 18 along the seam where the two cone halves meet. The recessed area or second cutout is configured to allow space to accommodate movement of the julienne blades into the retracted position and back into the extended position. When the julienne blades are rotated into the extended position, extending into the center of the cone, the central recess is substantially filled by the horizontal flange 55. When the julienne blades are rotated into the retracted position, the julienne blades fill the central recess, extending from the first cone half to the second cone half within the recess or cutout formed by the central portion.

The main slicing blade 30 is formed with a sharpened edge and a gap 35 between the blade 30 and an adjacent mounting plate to allow food to pass through the gap when it is sliced. Most preferably the blade and mounting plate are integrally formed from stainless steel and bent along the gap as illustrated in order to provide a strong surface for attachment. The mounting plate of the blade is mounted to a support 34 having a recessed seat configured to receive the mounting plate. The blade support is then attached to an outer surface of the first cone section 11 to mount the blade to the cone section. The blade and blade mount are positioned over an elongated opening 19 formed in the first cone section 11.

In the illustrated version of the invention, the slicer further includes a gripper 100. The gripper is fashioned with a circular perimeter, as viewed from above, so that it fits within the circular rim defined by the conical slicer. The gripper includes an upper handle 110 mounted to the upper end of the gripper, so that it can be grasped by a user for rotation. In one version, the handle is shaped as a planar plate, extending diametrically across the top of the gripper, to more easily allow rotation of the gripper.

The gripper includes an upper rim 120, and a lower portion which extends downwardly and inwardly from the upper rim. Most preferably, the overall shape of the gripper will be received within the boundaries of a cone which approximates the interior shape defined by the interior sidewalls 17 of the slicer. Consequently, the gripper may rotate within the cone and may extend downwardly into the cone. At the point at which the rim 120 of the gripper contacts an upper portion of the rim of the slicer, the remainder of the gripper is received within the slicer.

A lower section 140 of the gripper is recessed inward with respect to an upper section 150 of the gripper. The upper and lower sections of the gripper are sized and dimensioned such that the inward recess allows the lower section to avoid contact with the julienne blades when the gripper is extended into the slicer to the point at which the diameter of the upper rim 120 prevents further insertion of the gripper. At that point of insertion, at least some of the julienne blades may be at a height adjacent the lower section of the gripper.

The conical slicer housing may further include one or more ribs 180, 181 formed at an upper end of the conical halves forming the slicer and extending inwardly toward the center of the housing. The ribs are positioned to engage a lower edge 121 of the rim of the gripper, and thereby serve as a stop against further downward travel of the gripper. Most preferably, the ribs or other stops are positioned to allow downward travel of the gripper for complete slicing of a food item, but to prevent damage to the gripper by any of the blades.

The gripper terminates at its lowest surface with a plurality of teeth 160, configured to firmly grasp a food item for slicing.

In use, a user first selects whether to move the set of julienne blades to an extended or retracted position by rotating the blade post and julienne blades, as discussed above. The lateral flange 55 of the post serves as a handle to grasp for rotating the post, and in the extended position the lateral flange is preferably sized to cover the cutouts in the housing. A food item such as a carrot is inserted into the open base of the cone until it encounters the blades, and is then rotated as it is inserted into the cone. The user may optionally use the gripper to engage the food item by the teeth so that rotation of the gripper causes rotation of the food item. The rotation of the food item with respect to the slicing cone causes the food item to encounter the julienne blades (if extended) and the main slicing blade. Slices of carrot or other food item pass through the opening adjacent the main slicing blade, and are also cut into narrow strips if the julienne blades are extended. The outward extension of the handle portions provides a useful grip allowing the user to hold the device when slicing.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

I claim:

1. A hand-held spiralizer, comprising:

a first housing portion pivotally connected to a second housing portion for movement between an open position in which the first housing portion is pivoted away from the second housing portion and a closed position in which the first housing portion is pivoted toward the second housing portion, the first and second housing portions cooperating to form a cone-shaped housing having an interior space defined by an interior sidewall in the closed position, each of the first and second housing portions having a base end and a vertex end, the base end forming an open upper rim of the housing and the vertex end forming a lower opening in the housing;

a first handle portion attached to and extending laterally away from the base end of the first housing portion;

a second handle portion attached to and extending laterally away from the base end of the second housing portion, the first handle portion and the second handle portion being positioned close to each other to form a handle when the first housing portion and the second housing portion are in the closed position;

a blade attached to the interior sidewall of the first housing portion and having a sharp edge extending in a direction from the base end to the vertex end.

2. The hand-held spiralizer of claim 1, further comprising a plurality of julienne blades mounted on a julienne blade post, the julienne blade post being pivotally attached to the housing for pivotal movement between an extended position in which the julienne blades extend into the interior space, and a retracted position in which the julienne blades are rotated away from the interior space.

3. The hand-held spiralizer of claim 2, wherein the julienne blade post is pivotally attached to the first housing portion.

4. The hand-held spiralizer of claim 3, wherein the julienne blade post is mounted to the first housing portion at the vertex end and at the base end for pivotal movement along the sidewall.

5. The hand-held spiralizer of claim 4, further comprising a fastener positioned on at least one of the first handle portion and the second handle portion for retaining the first handle portion against the second handle portion.

6. The hand-held spiralizer of claim 5, wherein the fastener comprises at least one magnet.

7. The hand-held spiralizer of claim 4, further comprising a gripper having a handle and a plurality of spikes, the gripper being sized to fit within the upper rim of the housing.

8. The hand-held spiralizer of claim 7, further comprising a rib formed on the upper rim of the sidewall of the housing, the rib being positioned to limit travel of the gripper into the housing.

9. The hand-held spiralizer of claim 3, wherein the first housing portion includes a first edge and the second housing portion includes a second edge, the first edge being adjacent the second edge when the first and second housing portions are in the closed position, the first edge further having a cutout configured to support the julienne blade post for pivotal movement.

10. The hand-held spiralizer of claim 9, wherein the second edge of the second housing portion includes a second cutout, the second cutout being configured to allow the plurality of julienne blades to extend into the second cutout when the julienne blades are rotated to the retracted position.

11. The hand-held spiralizer of claim 9, wherein the julienne blade post further comprises a flange extending laterally away from the julienne blade post in a direction transverse to the direction in which the julienne blades extend from the julienne blade post.

12. The hand-held spiralizer of claim 9, wherein the julienne blade post rotates 90 degrees between the extended position and the retracted position.

13. The hand-held spiralizer of claim 1, wherein the first housing portion and the second housing portion divide the housing into equal halves.

* * * * *